US008696401B2

(12) United States Patent
Ichikawa

(10) Patent No.: US 8,696,401 B2
(45) Date of Patent: Apr. 15, 2014

(54) BACKSPIN TOY

(75) Inventor: Takashi Ichikawa, Tochigi (JP)

(73) Assignee: Tomy Company, Ltd., Tokyo (JP)

( * ) Notice: Subject to any disclaimer, the term of this patent is extended or adjusted under 35 U.S.C. 154(b) by 249 days.

(21) Appl. No.: 13/419,426

(22) Filed: Mar. 13, 2012

(65) Prior Publication Data

US 2012/0264351 A1 Oct. 18, 2012

(30) Foreign Application Priority Data

Apr. 18, 2011 (JP) ..... 2011-105686

(51) Int. Cl.
*A63H 29/00* (2006.01)

(52) U.S. Cl.
USPC ..... 446/429

(58) Field of Classification Search
USPC ..... 446/429, 430, 431, 436, 437, 440, 441, 446/442, 443, 450, 457, 462
See application file for complete search history.

(56) References Cited

U.S. PATENT DOCUMENTS 4,526,554 A * 7/1985 Goldfarb et al. ..... 446/429
4,541,813 A * 9/1985 Ikeda ..... 446/424
4,555,237 A * 11/1985 Nikaido ..... 446/355
4,959,035 A * 9/1990 Murasaki ..... 446/40
5,823,848 A * 10/1998 Cummings ..... 446/429
6,517,408 B1 * 2/2003 Rehkemper et al. ..... 446/462
6,676,476 B1 * 1/2004 Lund et al. ..... 446/234
8,388,405 B2 * 3/2013 Desent et al. ..... 446/429
8,579,674 B2 * 11/2013 Carlson et al. ..... 446/462
2008/0070473 A1 * 3/2008 Yu et al. ..... 446/435

FOREIGN PATENT DOCUMENTS

JP S52-009586 U 1/1977
JP S62-298398 A 12/1987
JP H08-005758 U 2/1996

* cited by examiner

*Primary Examiner* — Kurt Fernstrom
(74) *Attorney, Agent, or Firm* — Staas & Halsey LLP

(57) ABSTRACT

A backspin toy includes a vehicle having a front bumper, a platform having space for accommodating the vehicle therein, a flywheel disposed within the vehicle and rotatably supported within the vehicle, and a backspin unit that imparts backspin to the flywheel, disposed on the platform and engaging the flywheel, and configured to spin the flywheel rotatably supported within the vehicle to catapult the vehicle in a forward direction from the platform, the vehicle subsequently running in a reverse direction toward the platform at a limit of forward motion due to backspin of the flywheel imparted to the flywheel by the backspin unit.

7 Claims, 7 Drawing Sheets

BACKSPIN TOY

CROSS-REFERENCE TO RELATED APPLICATION

This patent application is based on and claims priority pursuant to 35 U.S.C. §119 from Japanese Patent Application No. 2011-105686, filed on Apr. 18, 2011, which is hereby incorporated by reference herein in its entirety.

BACKGROUND OF THE INVENTION

1. Field of the Invention

The present invention relates to a backspin toy, and more particularly, to a backspin toy configured to impart backspin to a flywheel rotatably provided to a vehicle so that once the vehicle is catapulted forward from a stand and reaches the limit of its forward motion, the backspin imparted to the flywheel causes the vehicle to run backward and return to the stand.

2. Description of the Related Art

Conventionally, toys are known that catapult a vehicle from a ramp, or transmit torque from a flywheel to a drive wheel or wheels of the toy vehicle, or use the flywheel itself as the drive wheel.

For example, Japanese Utility Model Application Publication No. S52-009586-U discloses a toy that applies torque to the flywheel of a wheeled vehicle placed on a starting stand, which then applies that torque to the wheels. Japanese Patent Application Publication No. S62-298389-A discloses a catapult device that applies torque to a flywheel-type drive mechanism coupled to the wheels of a toy car and catapults the car from a ramp. Further, Japanese Utility Model Application Publication No. H08-005758-U discloses rotating a flywheel of a wheeled toy placed on a catapult device and catapulting the toy.

However, although S52-009586-U provides a flywheel that applies inertial torque to the wheels of a wheeled vehicle that slides down a sloped runway for the purpose of making the wheeled vehicle run farther, the wheeled vehicle does not exhibit backspin.

Although S62-298389-A discloses storing torque in the flywheel-type drive mechanism coupled to the wheels of the toy car and then operating a catapult mechanism to launch the toy car with drive from the drive wheels generated by torque applied from the drive mechanism so that the speed of the toy car does not diminish rapidly, the toy car does not exhibit backspin.

Moreover, although H08-005758-U discloses a configuration in which the flywheel itself is the drive wheel, thus achieving high initial speed and stable take-off, the flywheel itself does not exhibit backspin.

All the approaches described above use the drive force of a flywheel to catapult a vehicle forward at high speed and make the vehicle go farther. None of these approaches, however, employs backspin.

SUMMARY OF THE INVENTION

The present invention provides a novel backspin toy comprising a vehicle having a front bumper, a platform having space for accommodating the vehicle therein, a flywheel disposed within the vehicle and rotatably supported within the vehicle, and a backspin unit. The backspin unit imparts backspin to the flywheel, disposed on the platform and engaging the flywheel, and is configured to spin the flywheel rotatably supported within the vehicle to catapult the vehicle at high speed in a forward direction from the platform. At a limit of forward motion, the vehicle subsequently runs backward toward the platform due to the backspin of the flywheel imparted to the flywheel by the backspin unit.

The backspin unit may comprise a rack and pinion assembly, a shaft and the pinion fixedly mounted on the flywheel, with the rack contacting the pinion. By pulling on the rack, the pinion spins the flywheel rotatably supported within the vehicle to catapult the vehicle at high speed from the platform.

Additionally, the rack is switchable between a first position that spins the flywheel in the forward direction and a second position that spins the flywheel in a reverse direction.

The backspin toy of the present invention may further comprise a spring, a lever, and a push member. The lever and the push member operate against a biasing force exerted by the spring to catapult the vehicle from the space in the platform at high speed.

In a preferred embodiment, the backspin toy of the present invention further comprises a first magnet contained in the front bumper of the vehicle and a target member containing a second magnet. The first magnet contained in the front bumper of the vehicle attracts the second magnet contained in the target member upon approach of the vehicle to the target.

The backspin toy of the present invention is configured as described above to impart backspin to a flywheel rotatably provided to a vehicle so that the vehicle, once it is catapulted forward at high speed from a stand and reaches the limit of its forward motion, the flywheel rotates in reverse, causing the vehicle to run backward and return to the stand, thus providing not only the thrill of speed of the vehicle running forward but also the unexpected pleasure of seeing the vehicle run in reverse. In addition, after hitting the target the vehicle runs backward with the target in magnetic tow to the stand, where the vehicle is stopped, to provide users with an extremely rich range of play possibilities.

BRIEF DESCRIPTION OF THE SEVERAL VIEWS OF THE DRAWINGS

A more complete appreciation of the disclosure and many of the attendant advantages thereof will be more readily obtained as the same becomes better understood by reference to the following detailed description of illustrative embodiments when considered in connection with the accompanying drawings, wherein.

DETAILED DESCRIPTION OF THE INVENTION

Figure 1:
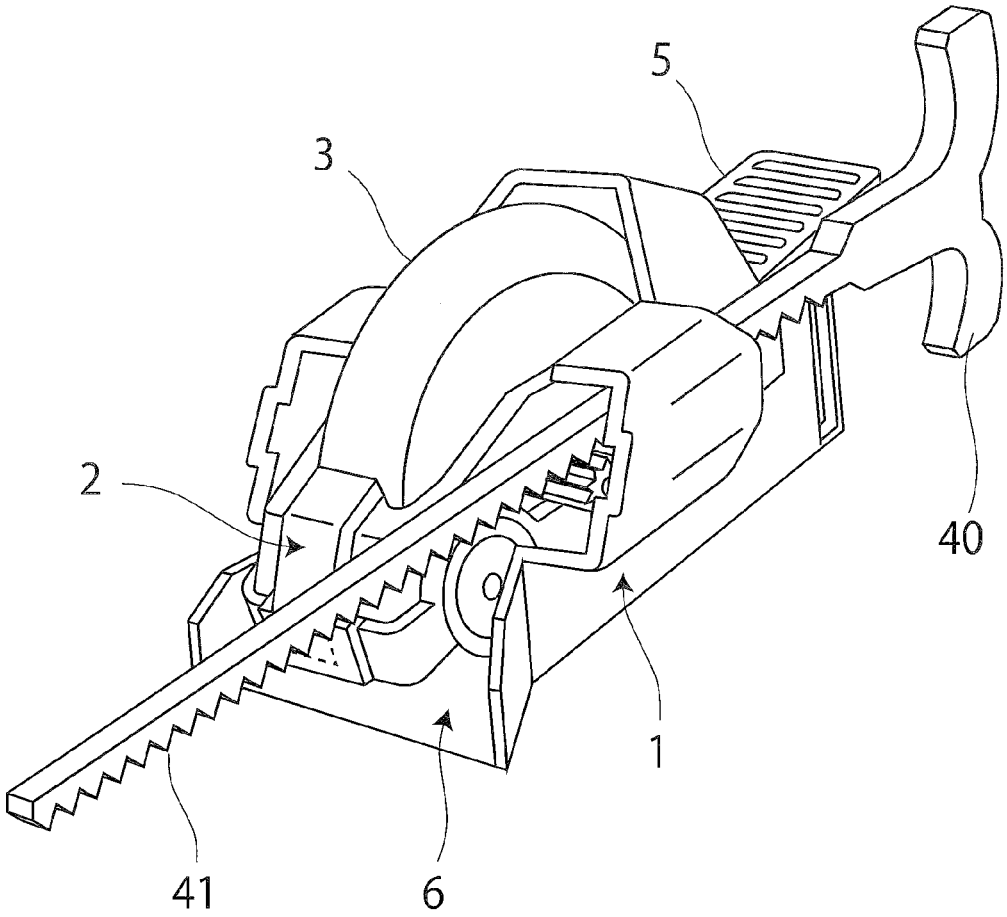
FIG. 1 is a diagram showing a perspective view of a backspin toy of the present invention.

A description is now given of preferred embodiments of the present invention. In describing preferred embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

FIG. 1 is a diagram showing a perspective view of a backspin toy of the present invention. A platform 1 has a space 6 for accommodating a vehicle 2 therewithin. A flywheel 3 is rotatably held in the vehicle 2.

Figure 2:
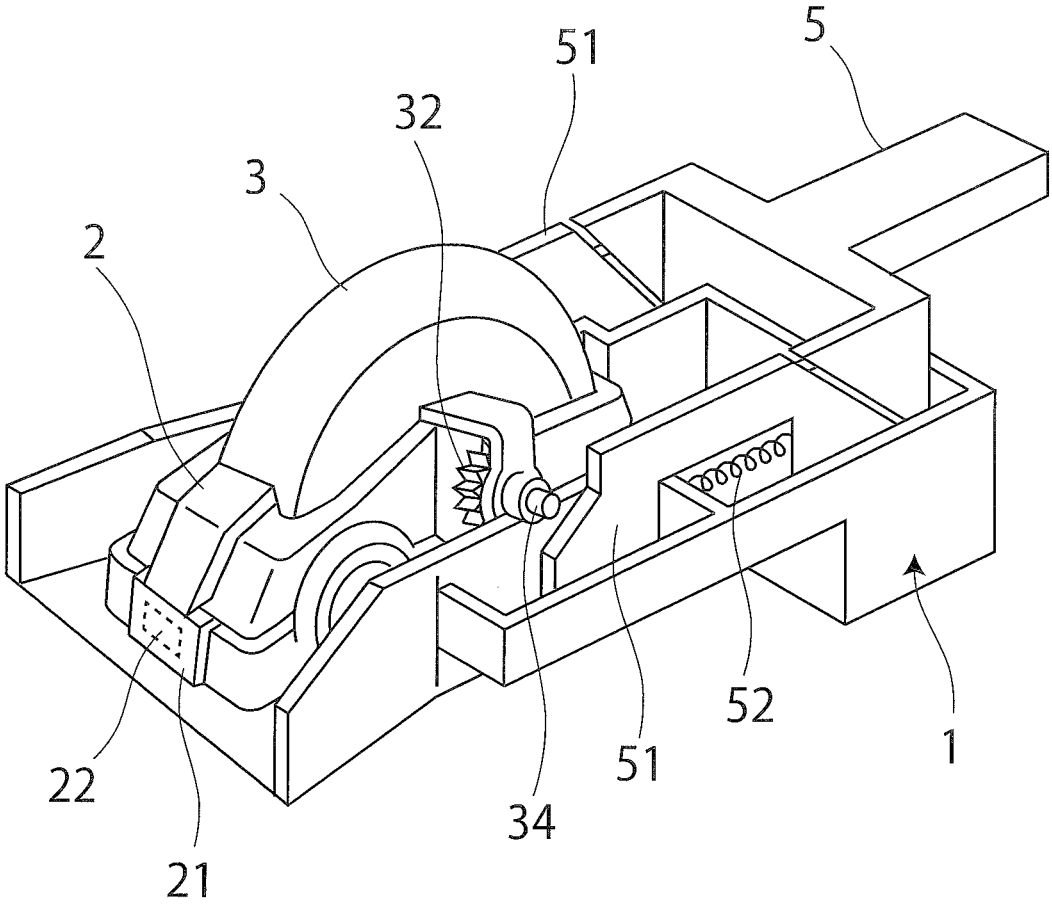
FIG. 2 is a diagram showing a perspective view of the backspin toy, with an outer cover removed to show essential portions.

FIG. 2 is a diagram showing a perspective view of the backspin toy, with an outer cover removed to show essential portions. As shown in FIG. 2, on one side of the flywheel 3 is a pinion 32 fixedly mounted on a shaft 31 that is itself fixedly mounted to the center of the flywheel 3.

Figure 3:
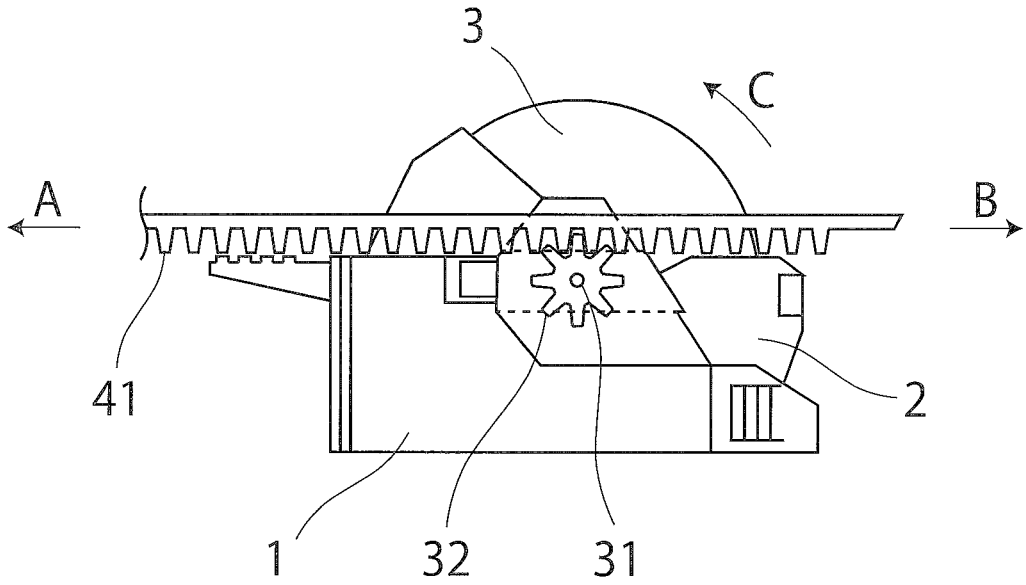
FIG. 3 is a partial side view of a flywheel spin, showing a rack of the unit at a first position.

FIG. 3 is one partial side view of a flywheel spin unit, in which arrow A indicates a direction in which a rack 41 is pulled, arrow B indicates a direction in which the vehicle 2 is catapulted, and arrow C indicates a direction in which the flywheel 3 is spun. In FIG. 3, the rack 41 is at a first position, above the pinion 32.

Figure 4:
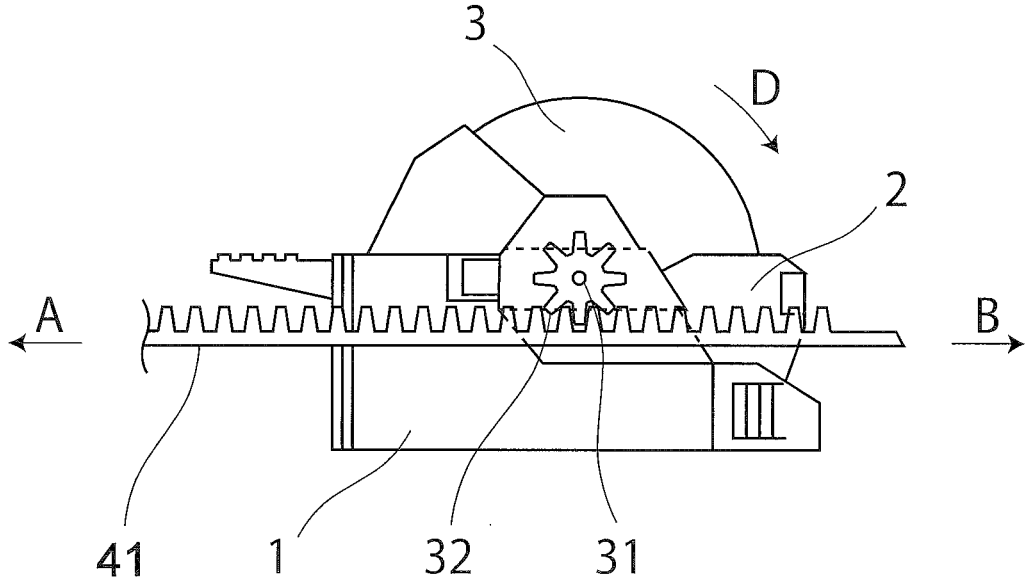
FIG. 4 is another partial side view of a flywheel spin unit, showing the rack of the unit disposed at a second position.

FIG. 4 is another partial side view of a flywheel spin unit, in which arrow A indicates a direction in which the rack 41 is pulled, arrow B indicates a direction in which the vehicle 2 is catapulted, and arrow D indicates a direction in which the flywheel 3 is spun, which is the opposite of the direction indicated by arrow C in FIG. 3. In FIG. 4, the rack 41 is at a second position, below the pinion 32.

As can be seen from FIGS. 3 and 4, the rack 41 that meshes with the pinion 32 fixedly mounted on the shaft 31 is positioned either at a first position above the pinion 32 or at a second position below the pinion 32. Pulling the rack 41 sharply in the direction of arrow A with the rack 41 at the first position spins the flywheel 3 in the direction of arrow C. By contrast, pulling the rack 41 sharply in the direction of arrow A with the rack 41 at the second position spins the flywheel 3 in the direction of arrow D.

Figure 5:
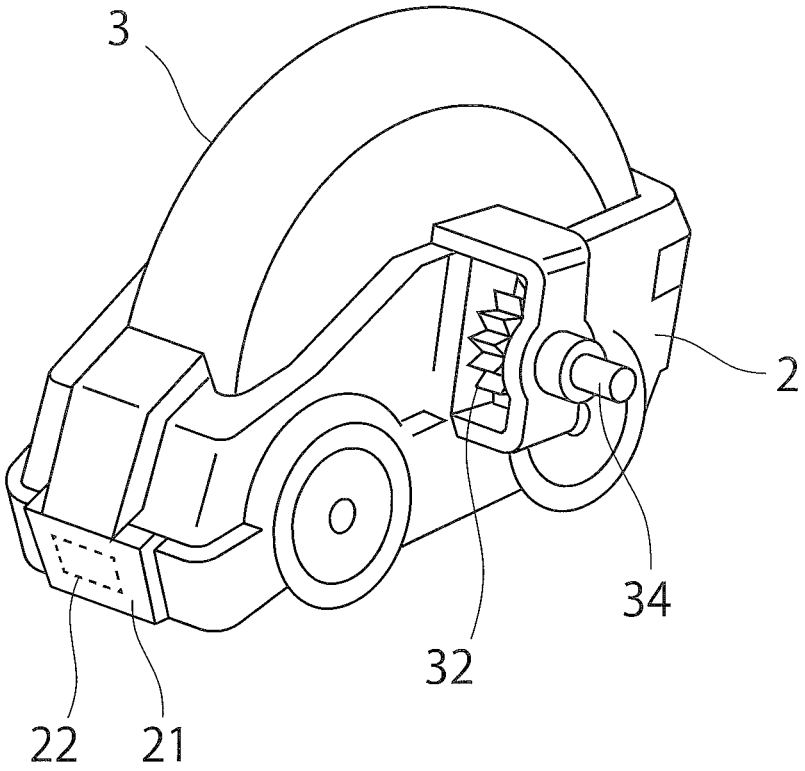
FIG. 5 is a perspective view of the vehicle of the backspin toy.

FIG. 5 is a perspective view of the vehicle 2 of the backspin toy. The vehicle 2 has a front bumper 21 that contains a first magnet 22. The first magnet 22 attracts and attaches a second magnet 81 contained in a target 8, and brings the target 8 back to the platform 1 when the vehicle 2 runs backward due to backspin.

Figure 6:
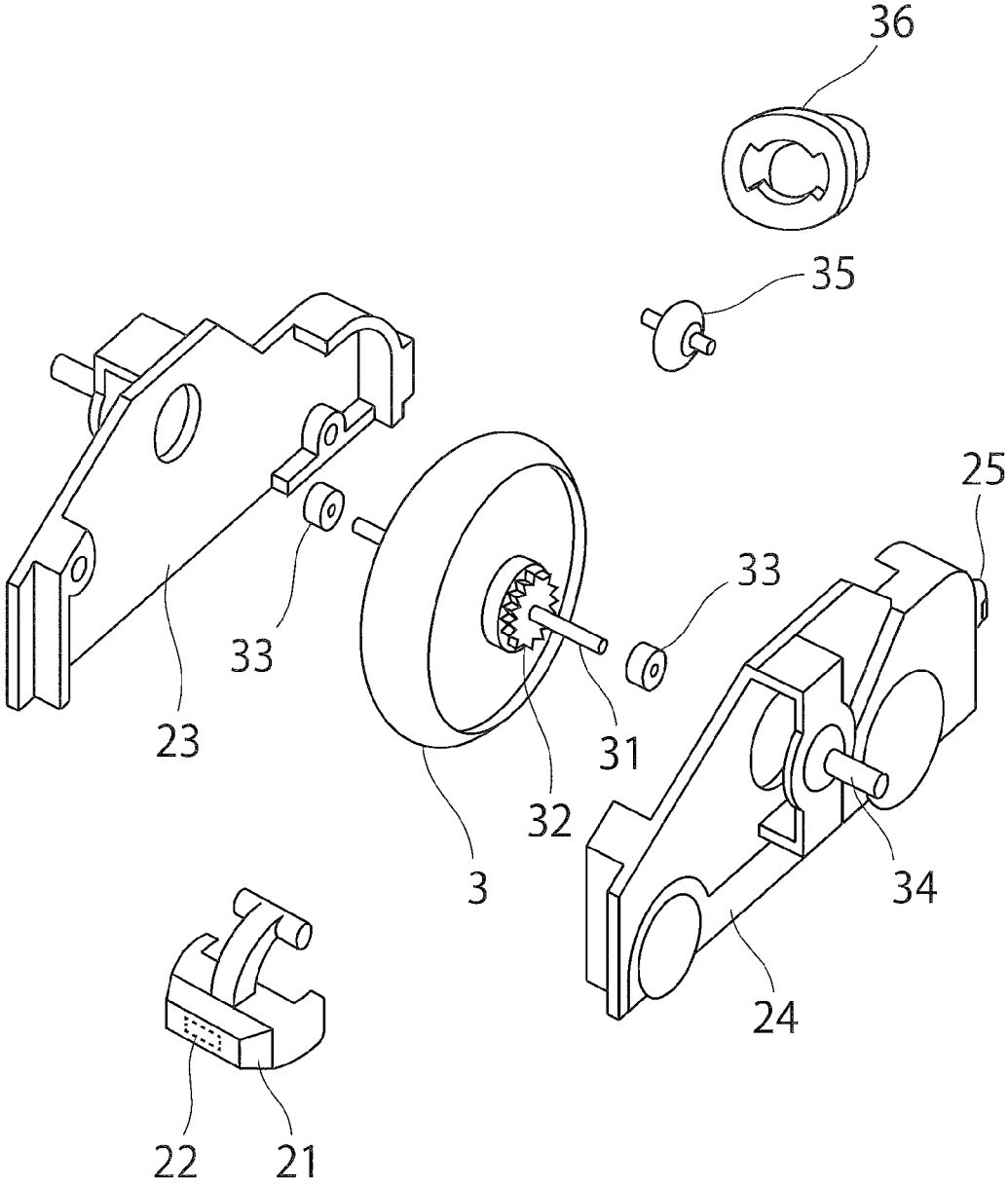
FIG. 6 is an exploded perspective view of the vehicle shown in FIG. 5.

FIG. 6 is an exploded perspective view of the vehicle shown in FIG. 5. To assemble the vehicle 2, the bumper 21 and an auxiliary wheel 35 of the flywheel 3 are fitted between right and left vehicle body halves 23 and 24, respectively, and finally a lock member 36 is locked to a lock portion 25 at the rear of the vehicle 2.

The flywheel 3 is rotatably held by seat bearings 34 via bearings 33, 33. The auxiliary wheel 35 is also held between right and left body halves 23 and 24, and functions to stabilize the vehicle 2 during its run.

Figure 7:
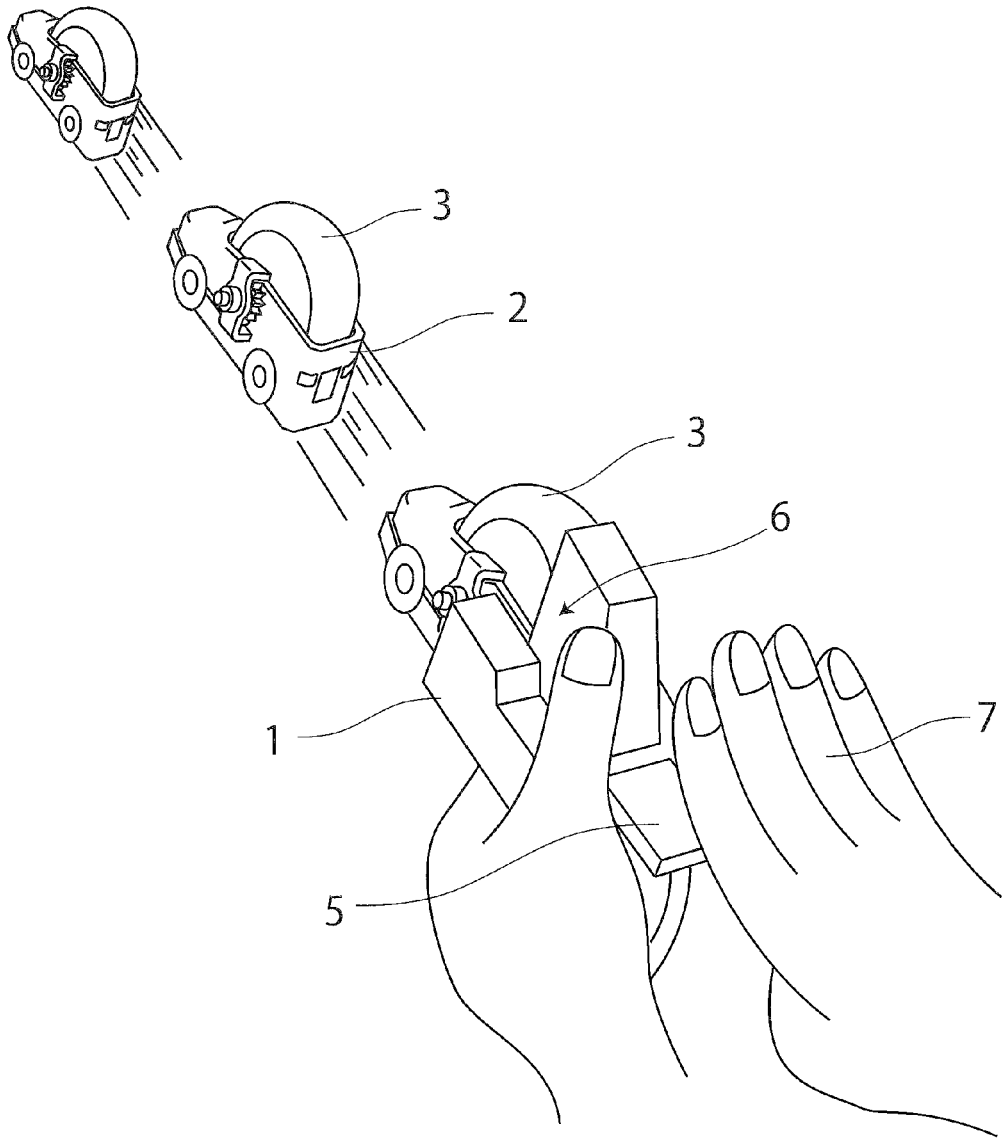
FIG. 7 is a diagram illustrating catapulting of the vehicle.
Figure 8:
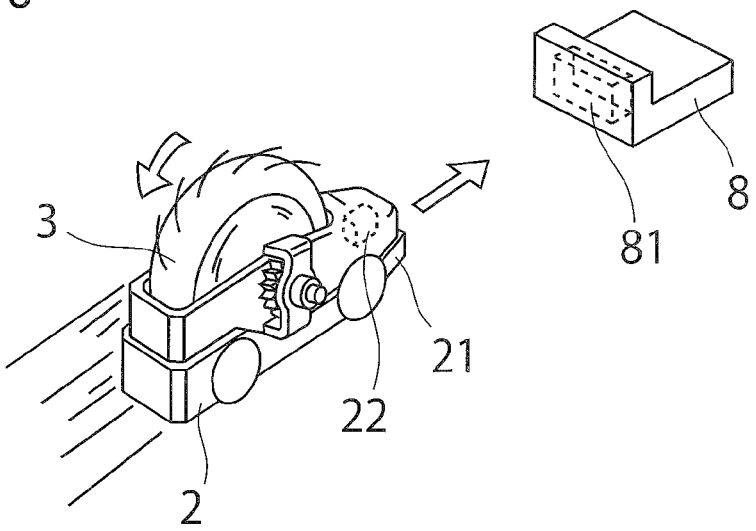
FIG. 8 is a perspective view of the vehicle in motion.
Figure 9:
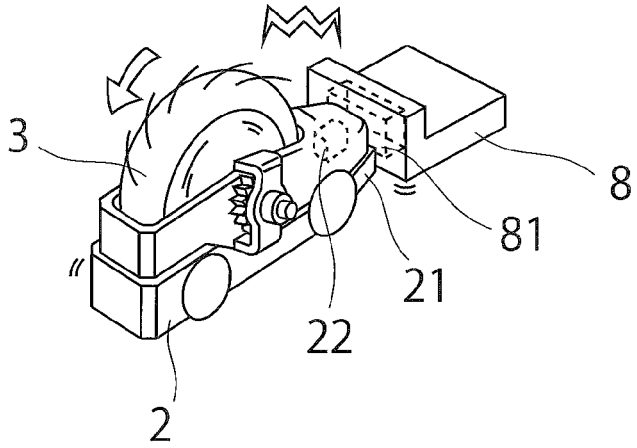
FIG. 9 is a perspective view showing the vehicle hitting a target.
Figure 10:
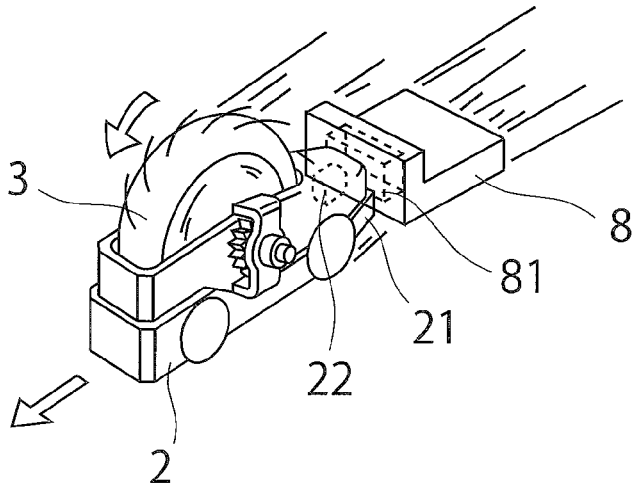
FIG. 10 is a perspective view of the vehicle running in reverse with the target attached.

FIG. 7 is a diagram illustrating catapulting of the vehicle 2 and FIG. 8 is a perspective view of the vehicle 2 in motion. FIG. 9 is a perspective view showing the vehicle 2 hitting a target 8 and FIG. 10 is a perspective view of the vehicle 2 running in reverse with the target 8 attached. When the vehicle 2 is catapulted at high speed, the flywheel 3 rotatably mounted on the vehicle 2 causes the vehicle 2 to move forward against friction between the ground point of the flywheel 3 and the floor as shown in FIG. 8. When the vehicle 2 reaches the limit of its forward motion or when it strikes the target 8 as shown in FIG. 9, the first magnet 22 inside the bumper 21 attracts the second magnet 81 in the target 8 and the spin imparted to the flywheel 3 causes the flywheel 3 itself to backspin, which in turn causes the vehicle 2 to run backwards to the platform 1 while dragging the target 8 with it as shown in FIG. 10.

Although the unit that imparts spin to the flywheel is described above as a rack and pinion assembly, the unit that imparts spin to the flywheel is not limited to a rack and pinion configuration. Alternatively, the unit that imparts spin to the flywheel may be configured as a rotary handle that drives a gear train, a motorized drive unit, or some other suitable means.

As described above, the backspin toy of the present invention imparts backspin to a flywheel rotatably provided to a vehicle so that, once the vehicle is catapulted forward at high speed from a stand and reaches the limit of its forward motion, the flywheel rotates in reverse, causing the vehicle to run backward and return to the stand to provide play full of possibilities.

As described above, the backspin toy of the present invention not only runs forward in a single direction to a lesser or greater distance at a lesser or greater speed as with the conventional toy but after a certain distance also runs backward to the stand from which it is catapulted, providing a variety of play possibilities that utilize this operation and providing entertainment to a wide range of users over a wide range of applications.

Numerous additional modifications and variations of the present invention are possible in light of the above teachings. It is therefore to be understood that, within the scope of the appended claims, the present invention may be practiced otherwise than as specifically described herein.

What is claimed is:

1. A backspin toy comprising:

a vehicle having a front bumper;

a platform having space for accommodating the vehicle therein;

a flywheel disposed within the vehicle and rotatably supported within the vehicle; and a backspin unit that imparts backspin to the flywheel, disposed on the platform and engaging the flywheel, and configured to spin the flywheel rotatably supported within the vehicle to catapult the vehicle in a forward direction from the platform, the vehicle subsequently running in a reverse direction toward the platform at a limit of forward motion due to backspin of the flywheel imparted to the flywheel by the backspin unit.

2. The backspin toy according to claim 1, wherein the backspin unit comprises a rack and pinion assembly, a shaft and the pinion fixedly mounted on the flywheel, the rack contacting the pinion and, when pulled, spinning the flywheel rotatably supported within the vehicle to catapult the vehicle from the platform.

3. The backspin toy according to claim 2, wherein the rack is configured to be switchable between a first position above the pinion that spins the flywheel in the forward direction and a second position below the pinion that spins the flywheel in a reverse direction.

4. The backspin toy according to claim 1, further comprising:

a spring;

a lever; and a push member, the lever and the push member operating against a biasing force exerted by the spring to catapult the vehicle from the space in the platform.

5. The backspin toy according to claim 1, further comprising:

a first magnet contained in the front bumper of the vehicle; and a target member containing a second magnet, wherein the first magnet contained in the front bumper of the vehicle attracts the second magnet contained in the target member upon approach of the vehicle to the target.

6. The backspin toy according to claim 1, wherein the backspin unit comprises:

a gear train; and a rotary handle that drives the gear train.

7. The backspin toy according to claim 1, wherein the backspin unit comprises a motorized drive unit.

* * * * *

UNITED STATES PATENT AND TRADEMARK OFFICE

CERTIFICATE OF CORRECTION

PATENT NO. : 8,696,401 B2
APPLICATION NO. : 13/419426
DATED : April 15, 2014
INVENTOR(S) : Ichikawa It is certified that error appears in the above-identified patent and that said Letters Patent is hereby corrected as shown below:

On the Title Page Item [56] (FOREIGN PATENT DOCUMENTS), Line 2, delete "S62-298398" and insert -- S62-298389 --, therefor.

Signed and Sealed this
Twenty-fourth Day of June, 2014

Michelle K. Lee

Michelle K. Lee
*Deputy Director of the United States Patent and Trademark Office*